US011028522B2

(12) United States Patent
Gasparini et al.

(10) Patent No.: US 11,028,522 B2
(45) Date of Patent: Jun. 8, 2021

(54) METHOD FOR CONTROLLING THE INTAKE OF WASHING LIQUID IN A LAUNDRY WASHING MACHINE, AND LAUNDRY WASHING MACHINE ACTUATING THAT METHOD

(71) Applicant: Electrolux Home Products Corporation N.V., Brussels (BE)

(72) Inventors: Mirko Gasparini, Spilimbergo (IT); Marco Carboni, Pordenone (IT); Andrea Buosi, Lignano Sabbiadoro (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 274 days.

(21) Appl. No.: 15/673,573

(22) Filed: Aug. 10, 2017

(65) Prior Publication Data

US 2017/0335504 A1 Nov. 23, 2017

Related U.S. Application Data

(62) Division of application No. 13/988,039, filed as application No. PCT/EP2011/070753 on Nov. 23, 2011, now abandoned.

(30) Foreign Application Priority Data

Nov. 29, 2010 (EP) ..... 10193012

(51) Int. Cl.

| | |
|---|---|
| ***D06F 33/34*** | (2020.01) |
| ***D06F 39/08*** | (2006.01) |
| ***D06F 33/00*** | (2020.01) |

(52) U.S. Cl.

CPC ..... *D06F 39/087* (2013.01); *D06F 33/00* (2013.01); *D06F 33/34* (2020.02); *D06F 2202/085* (2013.01); *D06F 2204/086* (2013.01)

(58) Field of Classification Search

CPC ..... D06F 33/02; D06F 39/087; D06F 39/088; D06F 2202/12; D06F 2202/10;

(Continued)

(56) References Cited

U.S. PATENT DOCUMENTS

| | | | | |
|---|---|---|---|---|
| 5,768,728 | A | 6/1998 | Harwood et al. | |
| 2003/0154559 | A1* | 8/2003 | Kim | D06F 13/08 8/158 |

(Continued)

FOREIGN PATENT DOCUMENTS

| | | | |
|---|---|---|---|
| DE | 4431654 A1 * | 3/1996 | D06F 39/087 |
| DE | 19946245 A1 | 4/2000 | |

(Continued)

OTHER PUBLICATIONS

International Search Report issued in related International Application No. PCT/EP2011/070753, dated Jun. 20, 2012.

(Continued)

*Primary Examiner* — Joseph L. Perrin
*Assistant Examiner* — Irina Graf
(74) *Attorney, Agent, or Firm* — RatnerPrestia

(57) ABSTRACT

A method for managing the load of washing liquid in a laundry washing machine (100) is provided. The laundry washing machine has a washing tub (110), in which washing liquid may be loaded, and a rotatable drum (115), rotatably accommodated in the washing tub (110), for containing the laundry to be washed. The method includes performing a sequence of partial loads of washing liquid into the washing tub (110). Each partial load provides for loading a corresponding liquid amount in the washing tub (110). For at least one of the partial loads in the sequence, the method provides for loading into the washing tub (110) a predetermined (Continued)

amount of washing liquid which depends on at least one indicative parameter related to one or more of the previous partial loads in the sequence.

13 Claims, 11 Drawing Sheets

(58) Field of Classification Search
CPC ..... D06F 2204/086; D06F 2220/00; D06F 33/00; D06F 2204/085; D06F 2202/08; D06F 33/30; D06F 33/32; D06F 33/34
See application file for complete search history.

(56) References Cited

U.S. PATENT DOCUMENTS

2004/0154645 A1 8/2004 Kim
2005/0125909 A1* 6/2005 Bellinetto ..... D06F 39/087 8/158
2006/0080787 A1* 4/2006 Choi ..... D06F 33/02 8/148
2006/0107468 A1* 5/2006 Urbanet ..... D06F 34/18 8/158
2006/0143836 A1 7/2006 Jung et al.
2008/0034809 A1* 2/2008 Bang ..... D06F 23/065 68/12.21
2008/0172804 A1* 7/2008 Vanhazebrouck ..... D06F 39/08 8/158
2010/0024490 A1* 2/2010 Nieh ..... D06F 33/02 68/12.02
2010/0064445 A1* 3/2010 Nieh ..... D06F 35/006 8/159

FOREIGN PATENT DOCUMENTS

DE 102006029670 A1 1/2008
DE 102006061080 B3 7/2008
EP 0787848 A1 8/1997
EP 1423563 A1 6/2004
EP 1679398 A1 7/2006
WO 2006018382 A1 2/2006
WO 2008000610 A1 1/2008

OTHER PUBLICATIONS

Office Action dated Aug. 30, 2017 in corresponding European Application No. 10193012.1.

* cited by examiner

METHOD FOR CONTROLLING THE INTAKE OF WASHING LIQUID IN A LAUNDRY WASHING MACHINE, AND LAUNDRY WASHING MACHINE ACTUATING THAT METHOD

CROSS-REFERENCE TO RELATED APPLICATION

This application is a divisional of U.S. application Ser. No. 13/988,039 filed Jan. 17, 2014, the contents of which is hereby incorporated by reference in its entirety, which is a national phase filing of International Application No. PCT/EP2011/070753, filed Nov. 23, 2011, which claims priority to European Application No. 10193012.1, filed Nov. 29, 2010.

BACKGROUND OF THE INVENTION

The present invention relates generally to the field of laundry washing and drying, particularly to laundry washing machines, meaning with this term laundry washers and laundry washers/dryers. Specifically, the invention relates to a method for controlling the intake of washing liquid, e.g. water, or a mixture of water and a washing agent, such as a detergent, in a laundry washing machine, and to a laundry washing machine implementing such a method.

OVERVIEW OF THE RELATED ART

Controlling the amount of washing water supplied to a laundry washing machine is an important issue, especially nowadays that electric energy consumption and, in general, environmental responsibility are very felt.

EP 1423563 discloses a method for washing in a washing machine, which can measure an accurate washing load before actual washing is carried out. The method includes (a) introducing laundry into a drum of the washing machine, (b) measuring an initial washing load caused by the introduced laundry, (c) repeating water supply to the drum for a fixed time period for maintaining a minimum water level determined by the initial washing load, taking water absorbed to the laundry into account, (d) after the preset water supply time period, determining a final washing load in the drum based on a number of water resupply times for an elapsed time from the initial water supply, and (e) washing the laundry by a washing method preset according to the determined final washing load.

WO 2008000610 discloses a method for handling laundry in a washing machine with a water level sensor, for determining the hydrostatic pressure of the fluid in the lye container. Water is introduced in the lye container to a pre-determined hydrostatic pressure p1 with a preset pressure difference between hydrostatic pressure p1 and a hydrostatic pressure p2. Firstly, (a) water is introduced to the lye container at a hydrostatic pressure below p1 until the hydrostatic pressure p1 is reached and (b) the introduction of water is then stopped until the hydrostatic pressure has dropped to p2. Furthermore, (c) the period tn for the n-th sequence of steps a) and b) is measured and (d) water introduction in step (a) stopped when (d1) the sum of the periods t1 to tn is greater than a given value tmax or (d2) the period tn is greater than a given period tmin.

WO 2006018382 aims at optimizing the completeness, uniformity and reproducibility of a wetting process in a program-controlled washing machine, which can be adjusted according to the amount of laundry in a washing drum, which is rotationally mounted in a lye container about a non-vertical axis by means of a water supply system and by means a control device, said process being temporally controlled by the supply of water into the lye container. The wetting process is divided up into a series of phases (Ph1-Ph3) corresponding to the various amounts (small, medium, large) of laundry that is to be treated. As a result, it is possible to adapt the wetting process according to the number and formation of individual phases in relation to the amount of laundry that is to be treated.

In DE 19946245 the value is registered by the program control and is in addition to the initial weighing carried out by a weight sensor before water is introduced into the drum. The process involves calculating an actual laundry weight value from the initial measuring value and the additional value by means of an adjusting circuit integrated into the program control. The program control continues the washing program with washing parameters which relate to the actual weight value.

SUMMARY OF THE INVENTION

The Applicant has found that none of the abovementioned methods is satisfactory from the point of view of the water and electric power consumptions.

According to an aspect of the present invention there is provided a method for managing the load of washing liquid in a laundry washing machine comprising a washing tub, in which washing liquid may be loaded, and a rotatable drum, rotatably accommodated in the washing tub, for containing the laundry to be washed. The method includes performing a sequence of partial loads of washing liquid into said washing tub. Each partial load provides for loading a corresponding liquid amount in the washing tub. For at least one of said partial loads in the sequence, the method provides for loading into the washing tub a predetermined amount of washing liquid which depends on at least one indicative parameter related to one or more of the previous partial loads in the sequence.

In principle, an embodiment of the present invention provides for carrying out a sequence of partial water loads; the amount of water in each partial load of the sequence is selected among a collection of already predetermined partial amounts based on indicative parameters of the previous partial loads in the sequence. As will become more clear in the following of the present description, with the expression "load of a predetermined amount of water" (or of washing liquid) it is intended both a partial load of an amount of water (washing liquid) whose value has been previously fixed (e.g., a partial load of X liters, wherein X is a prefixed value) and a partial load of an amount of water (washing liquid) dosed so that the overall amount of water (washing liquid) loaded before that partial load plus the amount of water (washing liquid) loaded by that partial load reaches a previously fixed value (e.g., a partial load of an amount of water such that the overall amount of loaded water reaches Y liters, wherein Y is a further prefixed value).

It is underlined that, even if the above mentioned partial load of an amount of water dosed so that the overall amount of water loaded before that partial load plus the amount of water loaded by that partial load reaches a previously fixed value is not a fixed value, since it depends on how much water has been loaded before this partial load (i.e., on how many partial loads have been performed before this partial load), the latter is anyway a load of a "predetermined" amount of water, since the amount of water loaded in this partial load is exactly the difference from the above mentioned predetermined fixed value and one or more predetermined values corresponding to the partial loads performed before.

It is also underlined that the amount of water loaded in all the above mentioned partial water loads is advantageously directly measured by a suitable metering device, for example a flowmeter associated to the water load system of the laundry machine in such a way to directly measure the exact amount of water admitted into the washing tub; this ensures that the amount of water admitted into the washing tub at each partial load is exactly the predetermined amount selected among the collection of already predetermined partial amounts based on indicative parameters of the previous partial loads in the sequence. In this way the amount of water admitted at any partial load isn't affected by for example by the pressure of water provided by the water socket to which the laundry machine is connected, as it would be if, for example, the admitted amount of water would be calculated as a function of the time in which the electrovalve provided at the inlet of the water load system of the laundry machine is open (in which case the actual amount of water admitted into the tub would depend on the pressure of water).

According to an embodiment of the present invention, said loading into the washing tub a predetermined amount of washing liquid, for at least one of said partial loads in the sequence, is conditioned to the fact that a predetermined level of free washing liquid in the laundry washing machine is not attained yet.

Preferably, said at least one indicative parameter related to one or more of the previous partial loads in the sequence comprises at least one among the level of free washing liquid and/or the value of the pressure in said washing tub reached before said at least one of said partial loads in the sequence, the time taken by the level of free water/pressure in the washing tub for falling below a minimum level from the end of the previous partial load, the total amount of water loaded by the previously performed partial loads, and the number of partial loads already performed.

Advantageously, said loading into the washing machine a predetermined amount of washing liquid for at least one of said partial loads in the sequence comprises loading a previously fixed amount of washing liquid selected among a collection of already predetermined partial amounts.

According to an embodiment of the present invention said loading into the washing machine a predetermined amount of washing liquid for at least one of said partial loads in the sequence comprises loading an amount of washing liquid dosed in such a way that the overall liquid amount of washing liquid in the laundry washing machine before said at least one of said partial loads plus said dosed amount reaches a previously fixed quantity.

According to a further embodiment of the present invention, said previously fixed quantity is calibrated for the washing of at least one among substantially half a standard load of laundry the laundry washing machine is configured to house, and substantially the standard load of laundry the laundry washing machine is configured to house.

Preferably, before said loading into the washing machine a predetermined amount of washing liquid for at least one of said partial loads in the sequence, the method provides for selecting whether the next partial load is to be cold washing liquid or hot washing liquid.

Another aspect of the present invention relates to a laundry washing machine comprising a washing tub, in which washing liquid may be loaded, and a rotatable drum, rotatably accommodated in the washing tub, for containing the laundry to be washed. The laundry washing machine further includes a metering device for measuring the amount of water loaded into the washing tub, a dosing device, for activating/deactivating the loading of water into the washing tub, and a control unit, operatively connected to said metering device and to said dosing device for managing the load of washing liquid in said washing tub in such a way to perform a sequence of partial loads of washing liquid into said washing tub. Each partial load provides for loading a corresponding liquid amount in the washing tub. Said control unit is configured for loading into the washing tub a predetermined amount of washing liquid, for at least one of said partial loads in the sequence, which depends on at least one indicative parameter related to one or more of the previous partial loads in the sequence.

Advantageously, said control unit is configured to condition said loading into the washing tub a predetermined amount of washing liquid, for at least one of said partial loads in the sequence, to the fact that a predetermined level of free washing liquid in the laundry washing machine is not attained yet.

According to an embodiment of the present invention, said at least one indicative parameter related to one or more of the previous partial loads in the sequence comprises at least one among the level of free washing liquid and/or the value of the pressure in said washing tub reached before said at least one of said partial loads in the sequence, the time taken by the level of free water/pressure in the washing tub for falling below a minimum level from the end of the previous partial load, the total amount of water loaded by the previously performed partial loads, and the number of partial loads already performed.

Advantageously, said control unit is configured in such a way that loading into the washing machine a predetermined amount of washing liquid for at least one of said partial loads in the sequence comprises loading a previously fixed amount of washing liquid selected among a collection of already predetermined partial amounts.

Preferably, said control unit is configured in such a way that loading into the washing machine a predetermined amount of washing liquid for at least one of said partial loads in the sequence comprises loading an amount of washing liquid dosed in such a way that the overall liquid amount of washing liquid in the laundry washing machine before said at least one of said partial loads plus said dosed amount reaches a previously fixed quantity.

According to an embodiment of the present invention, said control unit is configured in such a way that said previously fixed quantity is calibrated for the washing of at least one among substantially half a standard load of laundry the laundry washing machine is configured to house, and substantially the standard load of laundry the laundry washing machine is configured to house.

According to a further embodiment of the present invention, said dosing device is adapted for allowing selectively providing, at its outlet, cold water or hot water, and wherein said control unit is configured in such a way that before said loading into the washing machine a predetermined amount of washing liquid for at least one of said partial loads in the sequence, said control unit selects whether the next partial load is to be cold washing liquid or hot washing liquid.

BRIEF DESCRIPTION OF THE DRAWINGS

These and other features and advantages of the present invention will appear more clearly from the reading of the following detailed description of some invention embodiments, provided merely by way of non-limitative examples. The description that follows will be better understood making reference to the attached drawings, wherein.

DETAILED DESCRIPTION OF EXAMPLE EMBODIMENTS

Figure 1:
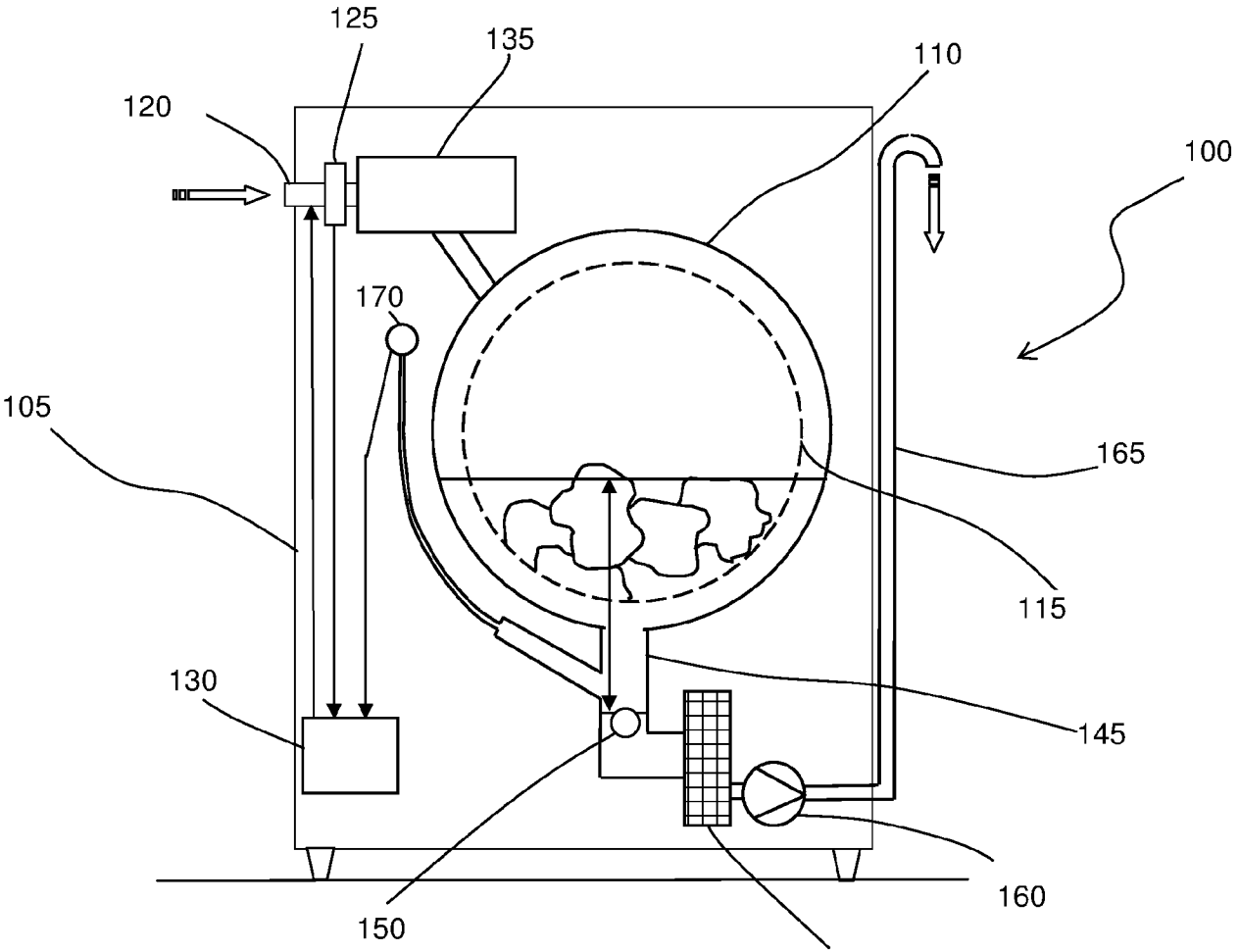
FIG. 1 schematically shows a laundry machine according to an embodiment of the present invention.

Referring to the drawings, in FIG. 1 there is schematically shown a laundry machine 100, for example a laundry washer. The laundry machine 100 comprises a cabinet 105 enclosing a washing tub 110 and, rotatably accommodated therein, a laundry drum 115, for containing the laundry to be washed. The laundry machine 100 has a water load system and a waste washing liquid discharge system. The water load system preferably comprises a dosing device, e.g. an electrovalve, 120, whose inlet is connectable (for example via a hose) to a water socket (not shown). In some embodiments of the invention, the laundry machine may be equipped with a dosing device adapted for allowing selectively providing, at its outlet, cold water or hot water; for example this different dosing device may comprise two electrovalves, one advantageously connectable to a cold water socket and the other advantageously connectable to a hot water socket, or an electrovalve with only one outlet and two inlets one advantageously connectable to a cold water socket and the other advantageously connectable to a hot water socket. A metering device, for example a flowmeter 125 is advantageously connected to the dosing device (e.g., electrovalve) outlet. The electrovalve 120 is preferably controlled by a control unit 130, which receives the readings from the flowmeter 125. The loaded water is preferably made to pass through a container of detergents 135 and then supplied to the washing tub 110; advantageously, a by-pass circuit may be provided, internally or externally to the container of detergents 135, adapted for allowing the loaded water to be adducted to the washing tub directly, i.e. without being mixed with one or more detergents contained in the container 135. The washing liquid discharge system advantageously comprises a discharge duct 145, for example at the bottom of the washing tub 110, preferably closable by a valve 150; downstream the valve 150, an anti-fluff/anti-clog filter 155 is preferably provided, upstream a discharge pump 160 whose outlet is connected to a discharge hose 165, preferably connectable to a drain socket (not shown). A pressure sensor 170 (which may be a pressure switch) is advantageously provided, adapted to sense the pressure of the washing liquid present in the washing tub 110 and to provide the measure to the control unit 130.

Figure 2A:
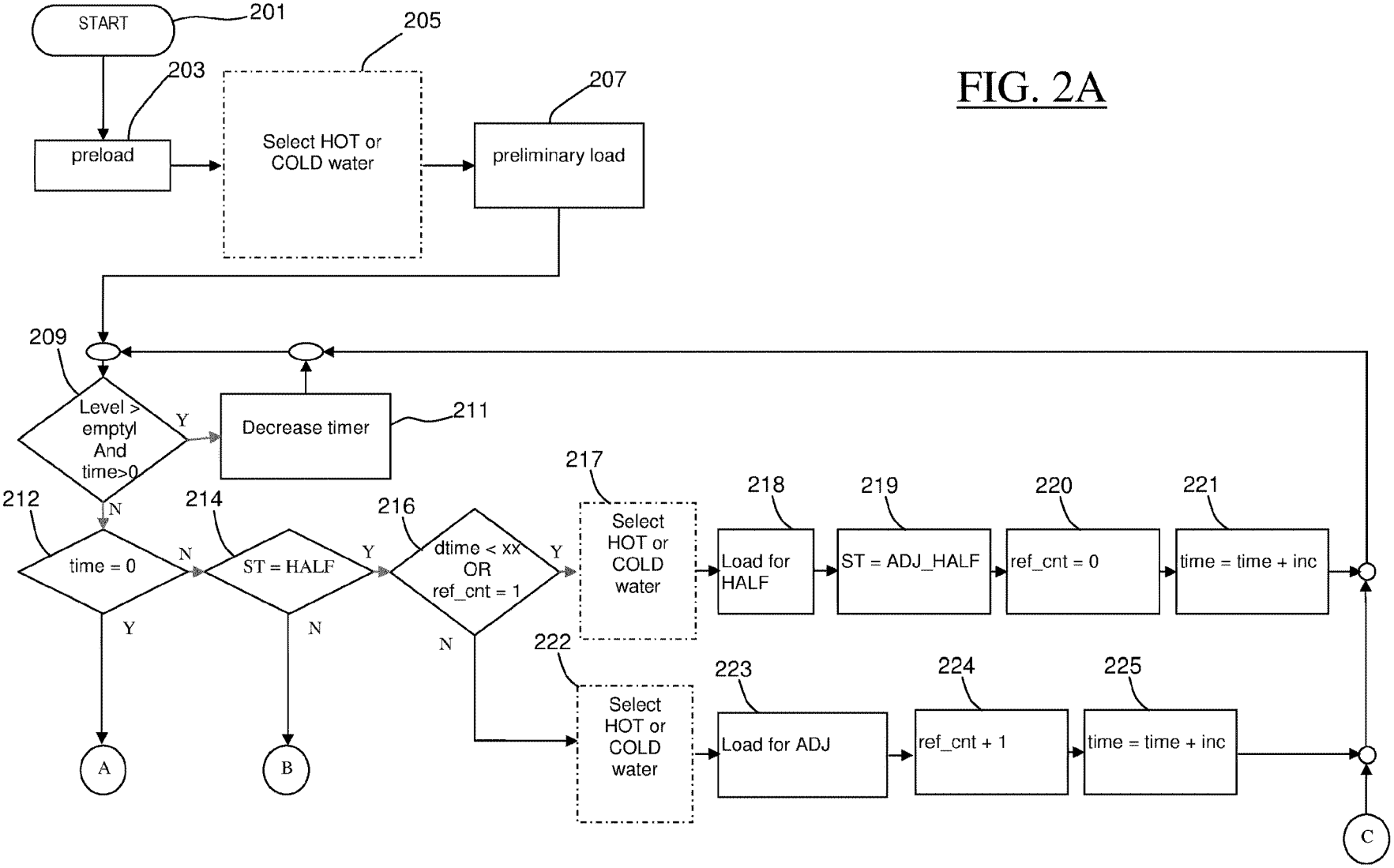
FIGS. 2A-2C show in terms of blocks some steps of a method according to an embodiment of the present invention.
Figure 2B:
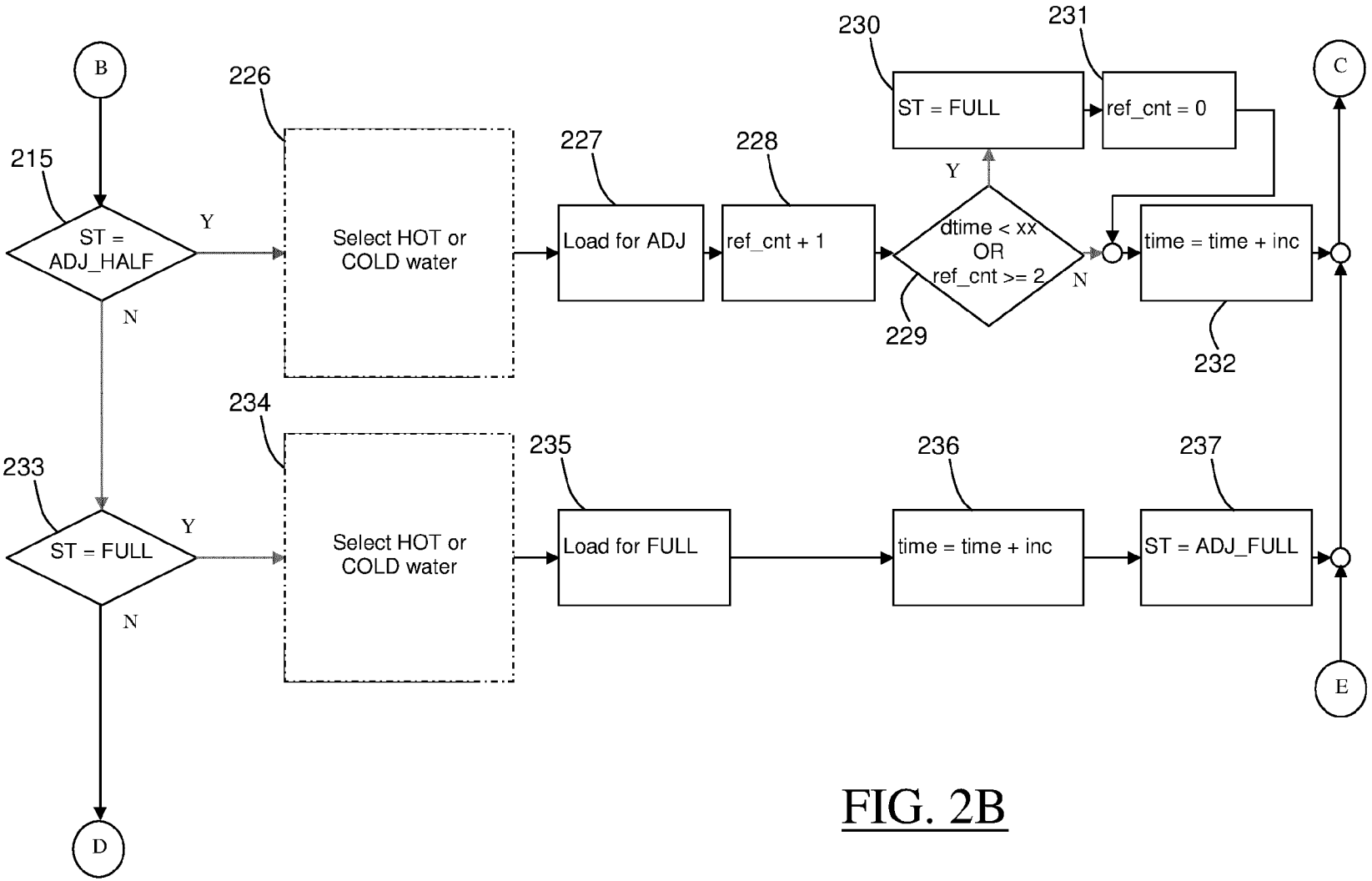
Figure 2C:
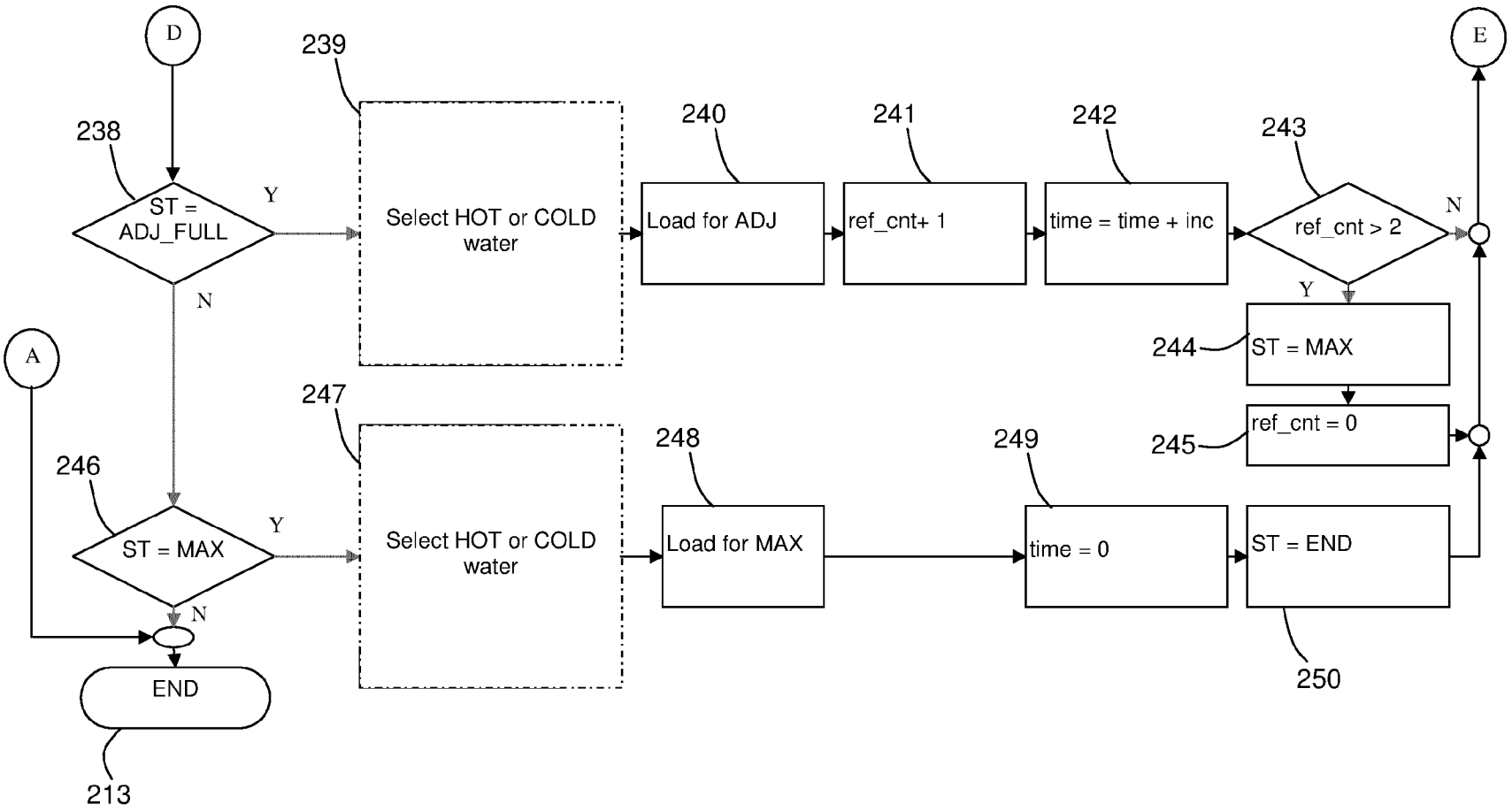

FIGS. 2A-2C illustrate in terms of blocks some steps of a method according to an embodiment of the present invention.

The method starts at 201. At the beginning, a pre-load of a preliminary fixed amount (e.g., 2 litres) of water is preferably made (block 203), for example by opening the electrovalve 120 (or, in case there are two electrovalves for the intake of cold and hot water, by opening preferably the electrovalve corresponding to the cold water). After the water pre-load, depending on the washing program selection made by the user, the control unit 130 advantageously selects (block 205) whether the next water load is to be cold water or hot water; step 205 is not present in case the laundry machine has only one electrovalve for the intake of cold water. Then (i.e. after block 205, if the latter is present, or directly after block 203, if block 205 is not present), a load of a further preliminary fixed amount (e.g., 6 l) of water is performed (block 207); this water load is advantageously controlled by means of the flowmeter 125, and the amount of water to be loaded is preferably the amount of water that would be sufficient for washing a minimum laundry load (e.g., a laundry load ranging from 0 to 1 kg).

Once a load of water has been performed, the level of free water varies because of the presence of the laundry in the laundry drum 115, which laundry absorbs water until becoming completely drenched. The amount of water absorbed by the laundry and the speed of the absorption strongly depend on the amount (clearly a greater amount of laundry absorbs more water that a smaller amount of the same type of laundry) and on the type of the laundry (for example if the laundry is made of cotton it absorbs more water that if it would be made of synthetic fibres) located in the laundry drum 115. Another cause of variation in the level of free water is given by the rotation of the laundry drum 115: with the rotation of the laundry drum 115, the laundry is squeezed and a portion of the water previously absorbed by the laundry is released in the washing tub 110, going to increase the level of free water.

For this purpose, the control unit 130 sets a timer time to a start value (e.g., equal to 4-5 minutes), and then enters a wait loop (blocks 209 and 211): during this wait loop, the timer time is progressively decreased, and the pressure in the washing tub 110, advantageously measured by the pressure switch 170, is monitored; the measured pressure provides an indication of the level of free water present in the washing tub 110. The measured pressure is advantageously converted into a measure of the level of free water in the washing tub 110, which is compared to a predetermined minimum level emptyl (for example, a level of 30 mm). In a further embodiment the measured pressure is compared to a predetermined minimum pressure level enptyp (i.e., the pressures are not converted in levels of free water). According to a still further embodiments of the present invention, instead of monitoring the pressure in the washing tub 110, the level of free water is directly measured, for example by a an optical device or a level sensor, and it is compared to the predetermined minimum level emptyl.

As long as the measured level of free water is higher than the minimum level emptyl (or as long as the measured pressure is higher than the minimum pressure level emptyp) and the value of the timer time is higher than zero, the loop is reiterated (exit branch "Y" of block 209), with the timer time that is decreased, preferably by a unit, every reiteration. As soon as one of the two abovementioned conditions become false (exit branch "N" of block 209), the control unit 130 exits the wait loop, and the timer timer is stopped.

If the exit from the wait loop has been determined by the expiration of the timer time (exit branch "Y" of block 212), the control unit 130 assesses that the amount of water that has been loaded until now in the washing tub 110 is sufficient to guarantee a correct washing of the laundry; in this case, the load of water is considered to be completed, and the method is terminated (block 213).

Conversely (exit branch "N" of block 212), if the measured level of free water falls below the minimum level emptyl before the expiration of the timer time (or if the measured pressure falls below the minimum pressure level emptyp), the control unit 130 assesses that the amount of water that has been loaded until now in the washing tub 110 is not sufficient to guarantee a correct washing of the laundry, and further loads of water should be performed.

The control unit 130 advantageously operates as a state machine, having a plurality of states ST. Specifically, according to an embodiment of the present invention, the control unit 130 is configured to operate in the following states:

- ST=HALF (the start state), corresponding to a condition in which the laundry load located in the laundry drum 115 is considered to be equal to about half the standard laundry load the laundry drum 115 is configured to accommodate;
- ST=ADJ_HALF, corresponding to a first adjustment condition;
- ST=FULL, corresponding to a condition in which the laundry load located in the laundry drum 115 is considered to be substantially equal to the standard laundry load;
- ST=ADJ_FULL, corresponding to a second adjustment condition;
- ST=MAX, corresponding to a condition in which the laundry load located in the laundry drum 115 is considered to be substantially equal to the maximum laundry load the laundry drum 115 is configured to accommodate, and
- ST=END, corresponding to a condition in which the control unit 130 forces the ending of the control procedure.

Coming back to the flow chart of FIG. 2A, once the control unit 130 has assessed that further loads of water have to be performed, the state ST thereof is checked (block 214); preferably, the control unit 130 checks whether its state ST is equal to HALF (exit branch "Y" of block 214) or not (exit branch "N" of block 214). In the latter case, the control unit 130 performs a further check, controlling if its state ST is equal to ADJ_HALF (block 215 shown in FIG. 2B).

If the state ST has been assessed to be HALF, the control unit 130 carries out water load operations specifically calibrated to a laundry load corresponding to about half the standard laundry load (however, as can be read in the following, there could be an exception in which, even with the state ST equal to HALF, the load is performed with a smaller amount of water).

Firstly, a check is made on the time taken by the level of free water in the washing tub 110 for falling below the minimum level emptyl from the end of the previous partial load (or on the time taken by the measured pressure in the washing tub 110 for falling below the minimum pressure level emptyp from the end of the previous partial load). This check is carried out by comparing the time dtime elapsed during the last wait loop—corresponding to the difference between the value assumed by the timer time at the beginning of the last wait loop and the value assumed when the level of free water falls below emptyl (or the measured pressure falls below emptyp)—with a predetermined threshold xx, set based on the specific model of the laundry machine 100 (block 216). At the same time, the control unit 130 checks the value of a refill counter ref_cnt (initially set to zero) indicative of the number of so-called "adjustment loads" performed until now. As will be described in the following, performing an adjustment load provides for loading in the washing tub 110 an additional, predetermined, small amount of water (e.g., 0.5 l).

If the time dtime is lower than the threshold xx—meaning that the water in the washing tub 110 has been rapidly absorbed by the laundry located in the laundry drum 115—or if the refill counter ref_cnt is equal to m (e.g., m=1)—meaning that m adjustment loads have been already performed —, the control unit 130 manages the carrying out of a load of a substantial amount of water (exit branch "Y" of block 216). Conversely, if the time dtime is higher than the threshold xx—meaning that the water in the washing tub 110 has been slowly and/or slightly absorbed by the laundry—or if the refill counter ref_cnt is lower than m—e.g., it is equal to zero, meaning that no adjustment loads have been performed —, the control unit 130 manages the carrying out of an adjustment load (exit branch "N" of block 216).

In the former case (exit branch "Y" of block 216), depending on the washing program selection made by the user, the control unit 130 selects (block 217) whether the water load to be performed is to be cold water or hot water (again, step 217 is not present in case the laundry machine has only one electrovalve for the intake of cold water). Then, the electrovalve 120 is opened and a load of water is performed (block 218); this load of water, preferably controlled by means of the flowmeter 125, is dosed in such a way that the overall amount of water loaded in the washing tub 110 (i.e., comprising the water amounts of the previous loads as well) corresponds to a predetermined amount of water—referred to as "half load amount"—calibrated for the washing of about half the standard laundry load the laundry drum 115 is configured to accommodate. For example, making reference to a laundry drum 115 configured to accommodate a standard laundry load of 9 Kg, the half load amount may be equal to about 13 liters. Once the water load is performed, the state ST of the control unit 130 is switched to ADJ_HALF (block 219), the refill counter ref_cnt is reset to zero (block 220), and the timer time is increased by an incremental amount (e.g., 2 minutes) for allowing the carrying out of refills of further water loads (block 221). At this point, the control unit 130 re-enters the wait loop (returning to block 209), with a refreshed timer time having a value equal to the one assumed at the end of the previous wait loop plus the incremental amount.

In the second case (exit branch "N" of block 216), after having selected—if possible—(block 222) whether the water load to be performed is to be cold water or hot water, the electrovalve 120 is opened and an adjustment load of a small amount of water (e.g., 0.5 liters) is performed (block 223). Then, the refill counter ref_cnt is increased by one (block 224) to signal that an adjustment load has been carried out, and the timer time is increased by an incremental amount (e.g., 1 minute) for allowing the carrying out of refills of further water loads (block 225). At this point, the control unit 130 re-enters the wait loop (returning to block 209), with a refreshed timer time having a value equal to the one assumed at the end of the previous wait loop plus the incremental amount.

It has to be underlined that, according to an embodiment of the present invention, the previously described adjustment load carried out in the block 223 can be performed only once, and in case the water in the washing tub 110 has been slowly and/or slightly absorbed by the laundry, for example because the laundry is almost drenched in water. Thus, the small water amount of the adjustment load might be sufficient to correctly wash the laundry, avoiding to waste excessive amounts of water (such as the water load provided in the block 218).

Returning back to block 214, if the control unit 130 has assessed that its state ST is different than HALF (exit branch "N" of block 214), a further check is performed, for controlling if the state ST is equal to ADJ_HALF (block 215).

In the affirmative case (exit branch "Y" of block 215), the control unit 130 carries out operations directed to perform an adjustment load, i.e., a load of a small amount of water.

After having selected—if possible—(block 226) whether the water load to be performed is to be cold water or hot water, the electrovalve 120 is opened and an adjustment load of a small amount of water (e.g., 0.5 liters) is performed (block 227). Then, the refill counter ref_cnt is increased by one (block 228) to signal that an adjustment load has been carried out.

At this point, a check is made on the time taken by the level of free water in the washing tub 110 for falling below the minimum level emptyl from the end of the previous partial load (or on the time taken by the measured pressure in the washing tub 110 for falling below the minimum pressure level emptyp from the end of the previous partial load). Again, this check is carried out by comparing the time dtime elapsed during the last wait loop—corresponding to the difference between the value assumed by the timer time at the beginning of the last wait loop and the value assumed when the level of free water falls below emptyl—with a predetermined threshold, for example the threshold xx (block 229). At the same time, the control unit 130 checks the value of the refill counter ref_cnt for assessing the number of adjustment loads performed until now.

If the time dtime is lower than the threshold xx—meaning that the water in the washing tub 110 has been rapidly absorbed by the laundry located in the laundry drum 115—or if the refill counter ref_cnt is at least equal to n (e.g., n=2)—meaning that at least n adjustment loads have been already performed—(exit branch "Y" of block 229), the control unit 130 sets its state ST to FULL (block 230), and then resets the refill counter ref_cnt to zero (block 231). It has to be appreciated that in this case, the control unit 130 has assessed that it is required to perform a further load of a substantial amount of water since the amount of laundry located in the laundry drum 115 is too much for the amount of water loaded in the washing tub 110 until now—the absorption rate being very high—or since even if at least two adjustment loads have been already performed, the level of free water fell below the minimum level emptyl (or the measured pressure in the washing tub 110 fell below the minimum pressure level emptyp) before the expiration of the timer time (in the previous wait loop). Then, the timer time is increased by an incremental amount (e.g., 1 minute) for allowing the carrying out of refills of further water loads (block 232). At this point, the control unit 130 re-enters the wait loop (returning to block 209), with a refreshed timer time having a value equal to the one assumed at the end of the previous wait loop plus the incremental amount.

If instead the time dtime is higher than the threshold xx—meaning that the water in the washing tub 110 has not been rapidly absorbed by the laundry located in the laundry drum 115—or if the refill counter ref_cnt is lower than n—meaning that at most n−1 adjustment loads (e.g., one) have been already performed—(exit branch "N" of block 229), the control unit 130 assesses that it would be possible not to perform a further load of a substantial amount of water since the water already loaded until now would be sufficient, or since a simple adjustment load would be sufficient. In this case, the state ST is kept to ADJ_HALF, and, after having increased the timer time by an incremental amount (e.g., 1 minute) (block 232), the control unit 130 directly re-enters the wait loop (returning to block 209).

Returning back to block 215, if the control unit 130 has assessed that its state ST is different than ADJ_HALF (exit branch "N" of block 215), a further check is performed, for controlling if the state ST is equal to FULL (block 233).

In the affirmative case (exit branch "Y" of block 234), the control unit 130 carries out water load operations specifically calibrated to a laundry load corresponding to about the standard laundry load the laundry drum 115 is configured to accommodate.

After having selected—if possible—(block 234) whether the water load to be performed is to be cold water or hot water, the electrovalve 120 is opened and a load of water is performed (block 235); this load of water, controlled preferably by means of the flowmeter 125, is dosed in such a way that the overall amount of water loaded in the washing tub 110 (i.e., comprising the water amounts of the previous loads as well) corresponds to a predetermined amount of water—referred to as "full load amount"-calibrated for the washing of about the standard laundry load the laundry drum 115 is configured to accommodate. For example, making reference to a laundry drum 115 configured to accommodate a standard laundry load of 9 Kg, the full load amount may be equal to about 19.5 liters. Then, the timer time is increased by an incremental amount (e.g., 2 minute) for allowing the carrying out of refills of further water loads (block 236), and the state ST of the control unit 130 is switched to ADJ_FULL (block 237). At this point, the control unit 130 re-enters the wait loop (returning to block 209), with a refreshed timer time having a value equal to the one assumed at the end of the previous wait loop plus the incremental amount.

Returning back to block 233, if the control unit 130 has assessed that its state ST is different than FULL (exit branch "N" of block 233), a further check is performed, for controlling if the state ST is equal to ADJ_FULL (block 238).

In the affirmative case (exit branch "Y" of block 238), the control unit 130 carries out operations directed to perform an adjustment load, i.e., a load of a small amount of water.

After having selected—if possible—(block 239) whether the water load to be performed is to be cold water or hot water, the electrovalve 120 is opened and an adjustment load of a small amount of water (e.g., 0.5 liters) is performed (block 240). Then, the refill counter ref_cnt is increased by one (block 241) to signal that an adjustment load has been carried out, and the timer time is increased by an incremental amount (e.g., 2 minutes) for allowing the carrying out of refills of further water loads (block 242).

At this point, the control unit 130 checks the value of the refill counter ref_cnt (block 243).

If the value of the refill counter ref_cnt is higher than n (exit branch "Y" of block 243), meaning that at least n+1 (e.g., 3) adjustment loads have been already performed, the control unit 130 sets its state ST to MAX (block 244), and then resets the refill counter ref_cnt to zero (block 245). It has to be appreciated that in this case, the control unit 130 has assessed that it is required to perform a further load of a substantial amount of water since even if at least three adjustment loads have been already performed, the level of free water fell below the minimum level emptyl (or the measured pressure in the washing tub 110 fell below the minimum pressure level emptyp) before the expiration of the timer time (in the previous wait loop). Then, the control unit 130 re-enters the wait loop (returning to block 209), with a refreshed timer time having a value equal to the one assumed at the end of the previous wait loop plus the incremental amount.

If instead the refill counter ref_cnt is not higher than n (exit branch "N" of block 243), the control unit 130 assesses that it would be possible not to perform a further load of a substantial amount of water since the water already loaded until now would be sufficient, or since a simple adjustment load would be sufficient. In this case, the state ST is kept to ADJ_FULL, and the control unit 130 directly re-enters the wait loop (returning to block 209).

Returning back to block 238, if the control unit 130 has assessed that its state ST is different than ADJ_FULL (exit branch "N" of block 238), a further check is performed, for controlling if the state ST is equal to MAX (block 246).

In the affirmative case (exit branch "Y" of block 246), the control unit 130 carries out water load operations specifically calibrated to a laundry load corresponding to the maximum laundry load the laundry drum 115 is configured to accommodate.

After having selected—if possible—(block 247) whether the water load to be performed is to be cold water or hot water, the electrovalve 120 is opened and a load of water is performed (block 248); this load of water, preferably controlled by means of the flowmeter 125, is dosed in such a way that the amount of water loaded in the washing tub 110 (i.e., comprising the water amounts of the previous loads as well) corresponds to a predetermined amount of water—referred to as "maximum load amount"—calibrated for the washing of about the maximum laundry load the laundry drum 115 is configured to accommodate. For example, making reference to a laundry drum 115 configured to accommodate a standard laundry load of 9 Kg, the maximum load amount may be equal to about 25 liters. Then, the timer time is reset to zero (block 249) and the state ST of the control unit 130 is switched to END (block 250). At this point, the control unit 130 re-enters the wait loop (returning to block 209). In this case, since the timer time has been reset, and the state ST of the control unit is END, the method is immediately terminated (block 213).

Reassuming, according to an embodiment of the present invention, the method of FIGS. 2A-2C provides for performing a sequence of partial water loads. The amount of water in each partial water load of the sequence is selected among a collection of predetermined amounts. Specifically, said collection of predetermined amounts include:

- the preliminary fixed amount (e.g., 2 liters) of the load performed at block 203;
- the preliminary fixed amount (e.g., 6 liters) of the load performed at block 207;
- the predetermined small amounts (e.g., 0.5 liters) of the adjustment loads performed at blocks 223, 227, 240;
- the amount of the load performed at block 218, which is dosed in such a way that the overall amount of water (i.e., the sum of the water loaded until that moment with the amount of the load performed at block 218) reaches the predetermined half load amount (e.g., 13 liters);
- the amount of the load performed at block 235, which is dosed in such a way that the overall amount of water (i.e., the sum of the water loaded until that moment with the amount of the load performed at block 235) reaches the predetermined full load amount (e.g., 19.5 liters), and
- the amount of the load performed at block 248, which is dosed in such a way that the overall amount of water (i.e., the sum of the water loaded until that moment with the amount of the load performed at block 248) reaches the predetermined maximum load amount (e.g., 25 liters).

After the carrying out of a preliminary set of steps, including the loads performed at blocks 203 and 207, the amount of water in each subsequent partial load is selected from the previously listed predetermined amount based on indicative parameters of previously performed partial loads.

Specifically, these indicative parameters may advantageously include the time taken by the level of free water in the washing tub (or by the pressure in the washing tub) for falling below the minimum level emptyl (or emptyp) from the end of the previous partial load, the total amount of water loaded by the previously performed partial loads, and the number of adjustment loads just performed.

Figure 3A:
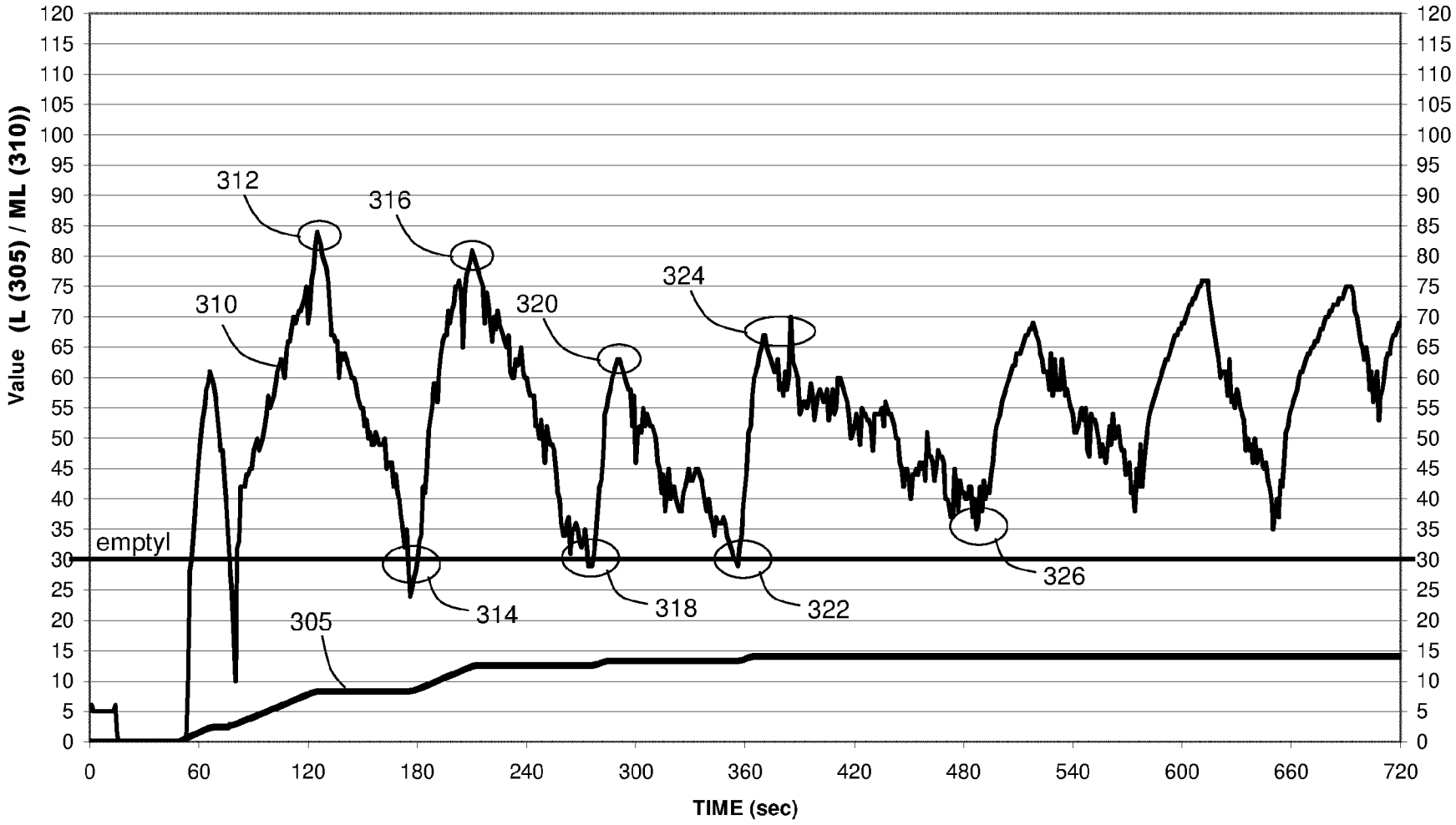
FIGS. 3A and 3B are diagrams showing an example of the evolution in time of the amount of loaded water and of the corresponding level of water in a washing tub of the laundry machine, respectively for a half laundry load and a full laundry load, for the method of FIGS. 2A-2C.

FIG. 3A is an exemplary diagram showing the evolution in time of the amount of loaded water (expressed in liters) and of the level of free water (expressed in millimeters) in the washing tub 110 of the laundry machine 100 during the execution of the method of FIGS. 2A-2C according to the invention for a half laundry load (e.g., a laundry load of about 4 Kg).

The amount of water loaded through the opening of the electrovalve 120 is identified with the reference 305, while the level of free water in the washing tub 110 (but also the pressure in the washing tub has the same behaviour) is identified with the reference 310. In this example, the predetermined minimum level emptyl is equal to 30 millimeters.

The evolution in time of the amount of loaded water 305 is a non-decreasing function, comprising a respective increasing portion at each water load operation. The evolution in time of the level of free water 310 is strongly nonlinear. Indeed, the laundry absorbs water in an unpredictable way, based on the amount and type thereof; moreover, with the rotation of the laundry drum 115, the laundry is squeezed, and a portion of the water previously absorbed by the laundry is released in the washing tub 110, going to increase the level of free water. However, when the electrovalve 120 is opened for performing a load of water, the level of free water substantially increases, while, when the electrovalve 120 is closed and no water is added in the washing tub 110, the level of free water substantially decreases because of the absorption.

Making reference in particular to the example at issue, after the carrying out of the first two predetermined loads of water—i.e., the ones corresponding to the blocks 203 and 207—the level of free water reaches a first peak (see reference 312). The control unit 130 is in the state ST=HALF. Then, the timer time is set, and the wait loop is initiated; the level of free water decreases because of the absorption by the laundry load; said absorption is relatively quick, because the laundry is still not much drenched. For this reason, the level of free water falls below the minimum level emptyl before the timer time expiration (see reference 314). Since the duration in time of the decreasing (i.e., the time dtime) was relatively short, the electrovalve 120 is opened until the amount of loaded water reaches the half load amount (in the example at issue, 13 liters); as a consequence, the level of free water increases until reaching a second peak (see reference 316). Then, the control unit 130 state ST switches to ADJ_HALF. At this point, a further wait loop is initiated, and the level of free water decreases again. This time, the absorption is slower (compared to the previous one) because the laundry has started to become more drenched, but not so slow to leave the timer time to expire before the level of free water falls below the minimum level emptyl (see reference 318). Then, the electrovalve 120 is opened for performing a first adjustment load; as a consequence, the level of free water increases again until reaching a third peak (see reference 320). Since in this case the duration in time of the decreasing (dtime) was not so short, the control unit 130 maintains its state ST to ADJ_HALF; in this way, if a further load was necessary, this load must be an adjustment load again. This is the case of the example at issue, wherein the level of free water falls again below the minimum level emtyl before the expiration of the timer time (see reference 322). After the second adjustment load, the level of free water increases again until reaching a fourth peak (see reference 324); this time, when the next wait loop is initiated, and the level of free water starts to decrease again, the amount of water that has been loaded until now slows the decreasing to such an extent that the timer time expires before the reaching of the minimum level emtyl (see reference 326). At this point, the method is terminated, since the control unit 130 has assessed that the water loaded in the washing tub 110 is sufficient to allow a correct washing of the laundry. The subsequent variations of the level of free water depicted in FIG. 3A are caused by the operations performed during the carrying out of the selected washing program, and will not be described.

Figure 3B:
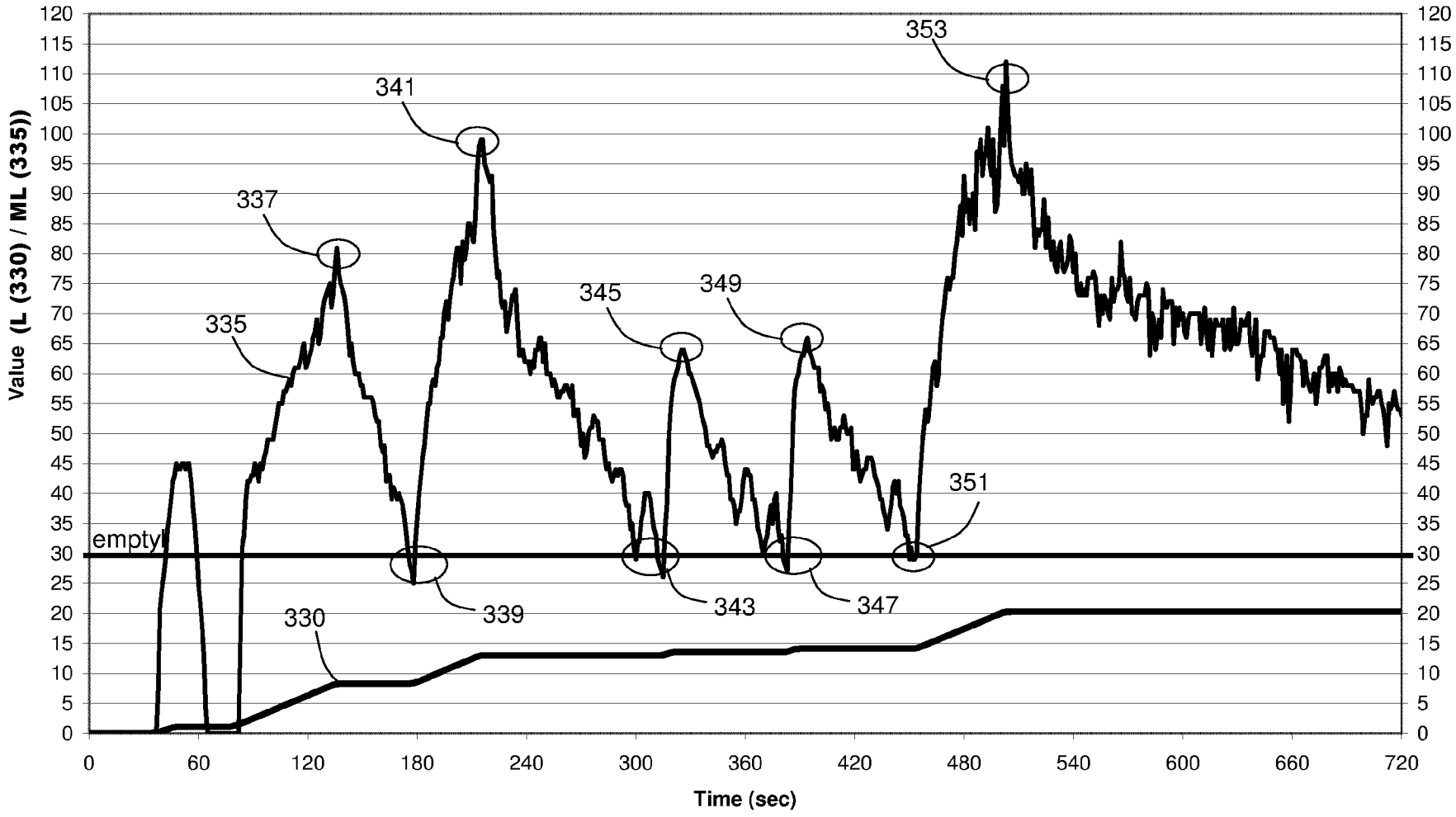

FIG. 3B is a further exemplary diagram showing the evolution in time of the amount of loaded water (in liters) and of the level of free water (expressed in millimeters) in the washing tub 110 of the laundry machine 100 during the execution of the method of FIGS. 2A-2C according to the invention for a full laundry load (e.g., 8 Kg).

The amount of water loaded through the opening of the electrovalve 120 is identified with the reference 330, while the level of free water in the washing tub 110 is identified with the reference 335. Again, the predetermined minimum level emptyl is equal to 30 millimeters.

After the carrying out of the first two predetermined loads of water—i.e., the ones corresponding to the blocks 203 and 207—the level of free water reaches a first peak (see reference 337). The control unit 130 is in the state ST=HALF. Then, the timer time is set, and the wait loop is initiated; the level of free water decreases because of the absorption by the laundry load; said absorption is relatively quick, because the laundry is still not much drenched. For this reason, the level of free water falls below the minimum level emptyl before the timer time expiration (see reference 339). Since the duration in time of the decreasing (dtime) was relatively short, the electrovalve 120 is opened until the amount of loaded water reaches the half load amount (in the example at issue, 13 liters); as a consequence, the level of free water increases until reaching a second peak (see reference 341). Then, the control unit 130 state ST switches to ADJ_HALF. At this point, a further wait loop is initiated, and the level of free water decreases again. This time, the absorption is slower (compared to the previous one) because the laundry has started to become more drenched, but not so slow to leave the timer time to expire before the level of free water falls below the minimum level emptyl (see reference 343). Then, the electrovalve 120 is opened for performing a first adjustment load; as a consequence, the level of free water increases again until reaching a third peak (see reference 345). Since in this case the duration in time of the decreasing (dtime) was not so short, the control unit 130 maintains its state ST to ADJ_HALF; in this way, if a further load was necessary, this load must be an adjustment load again. This is the case of the example at issue, wherein the level of free water falls again below the minimum level emtyl before the expiration of the timer time (see reference 347). After the second adjustment load, the level of free water increases again until reaching a fourth peak (see reference 349). Once more, the level of free water falls again below the minimum level emtyl before the expiration of the timer time (see reference 351). Since even after two adjustment loads the absorption is not sufficiently slow (meaning that the amount of laundry located in the laundry drum 115 is too much for the amount of water loaded in the washing tub 110 until now), the control unit 130 state ST is switched to FULL, so as the subsequent load involves a substantial amount of water. Thus, the electrovalve 120 is opened until the amount of loaded water reaches the full load amount (in the example at issue, 19.5 liters), and the level of free water increases again until reaching a fifth peak (see reference 353). This time, when the next wait loop is initiated, and the level of free water starts to decrease again, the amount of water that has been loaded until now slows the decreasing to such an extent that the timer time expires before the reaching of the minimum level emtyl. At this point, the method is terminated, since the control unit 130 has assessed that the water loaded in the washing tub 110 is sufficient to allow a correct washing of the laundry.

The proposed method allows to optimise the water load operations, strongly reducing the waste of water and electric power. With the proposed method, the water load results to be calibrated for the actual amount of laundry to be washed; therefore, avoiding to perform a load of an excessive amount of water, the electric power required for the water heating during the washing operations is strongly reduced. It has to be appreciated that said calibration is advantageously performed by the control unit 130 in an automatic manner, without the need that an user has to explicitly specify to the laundry machine 100 which is the actual amount of laundry to be washed.

Figure 4A:
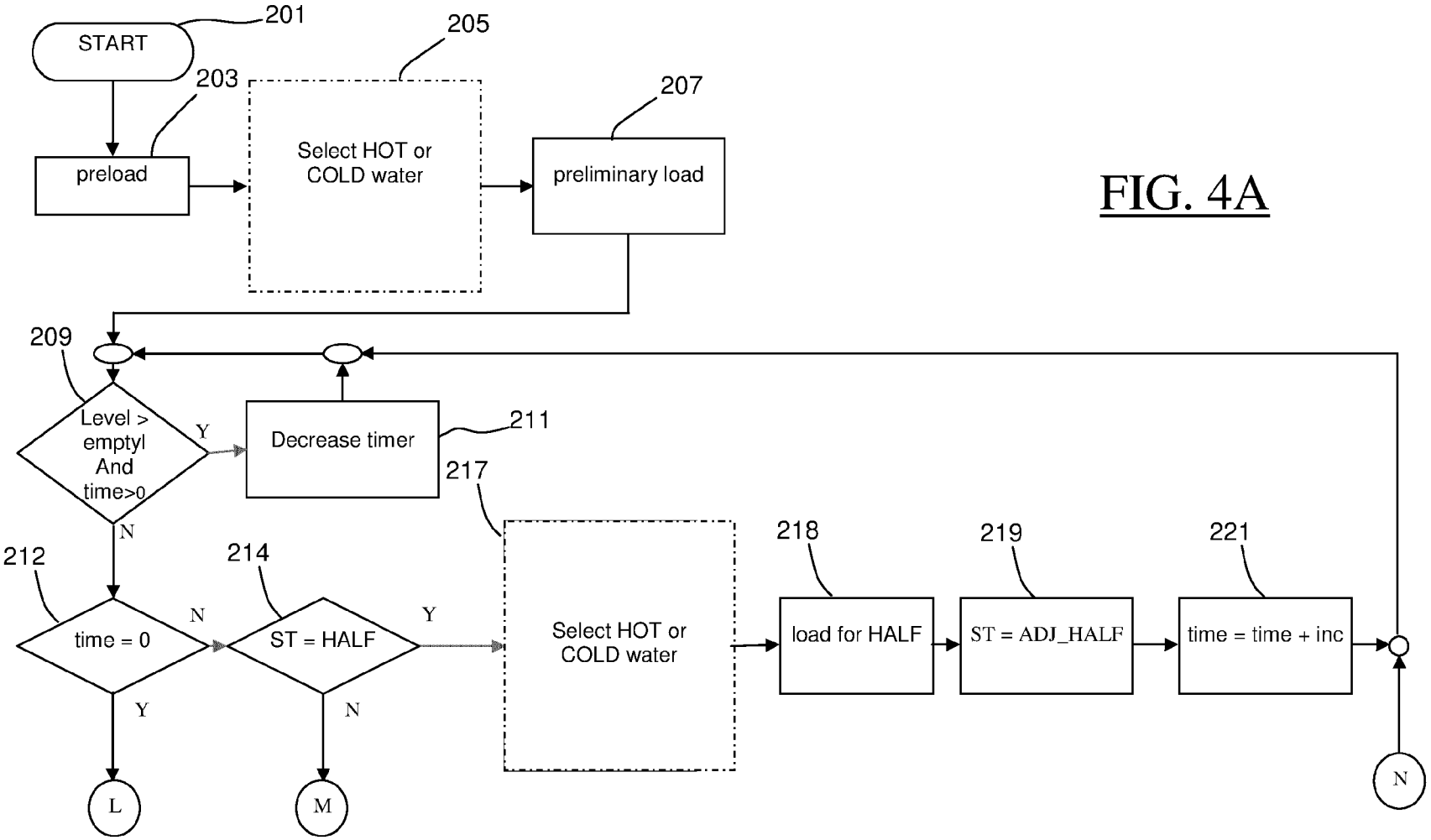
FIGS. 4A-4B show in terms of blocks some steps of a method according to a further embodiment of the present invention.
Figure 4B:
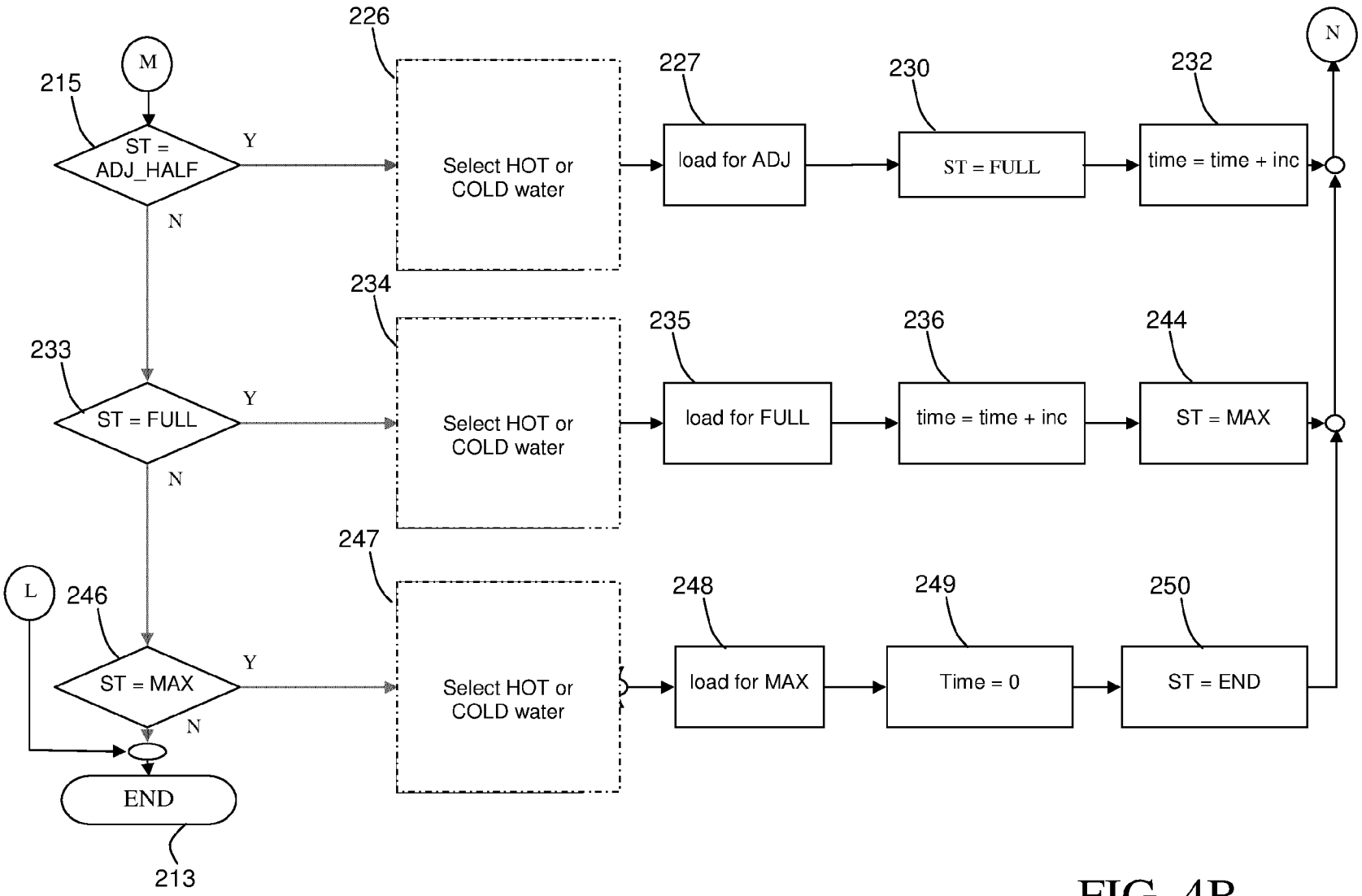

FIGS. 4A-4B illustrate several steps of a simplified version of the previously described method according to a further embodiment of the present invention.

Without entering into excessive details, compared to the method of FIGS. 2A-2C, the method of FIGS. 4A-4B:

- provides for five states ST only instead of six, lacking the state ST=ADJ_FULL corresponding to the second adjustment condition;
- does not provide for comparing the time dtime elapsed during the last wait loop with a threshold xx, and
- does not take into account the number of adjustment loads actually performed.

Although substantially equivalent to the method of FIGS. 2A-2C in its main features, the method of FIGS. 4A-4B is faster, since it provides for the carrying out of a lower number of water loads, but it is also less accurate, since the resulting overall water load cannot be accurately calibrated for the actual amount of laundry to be washed.

Figure 5A:
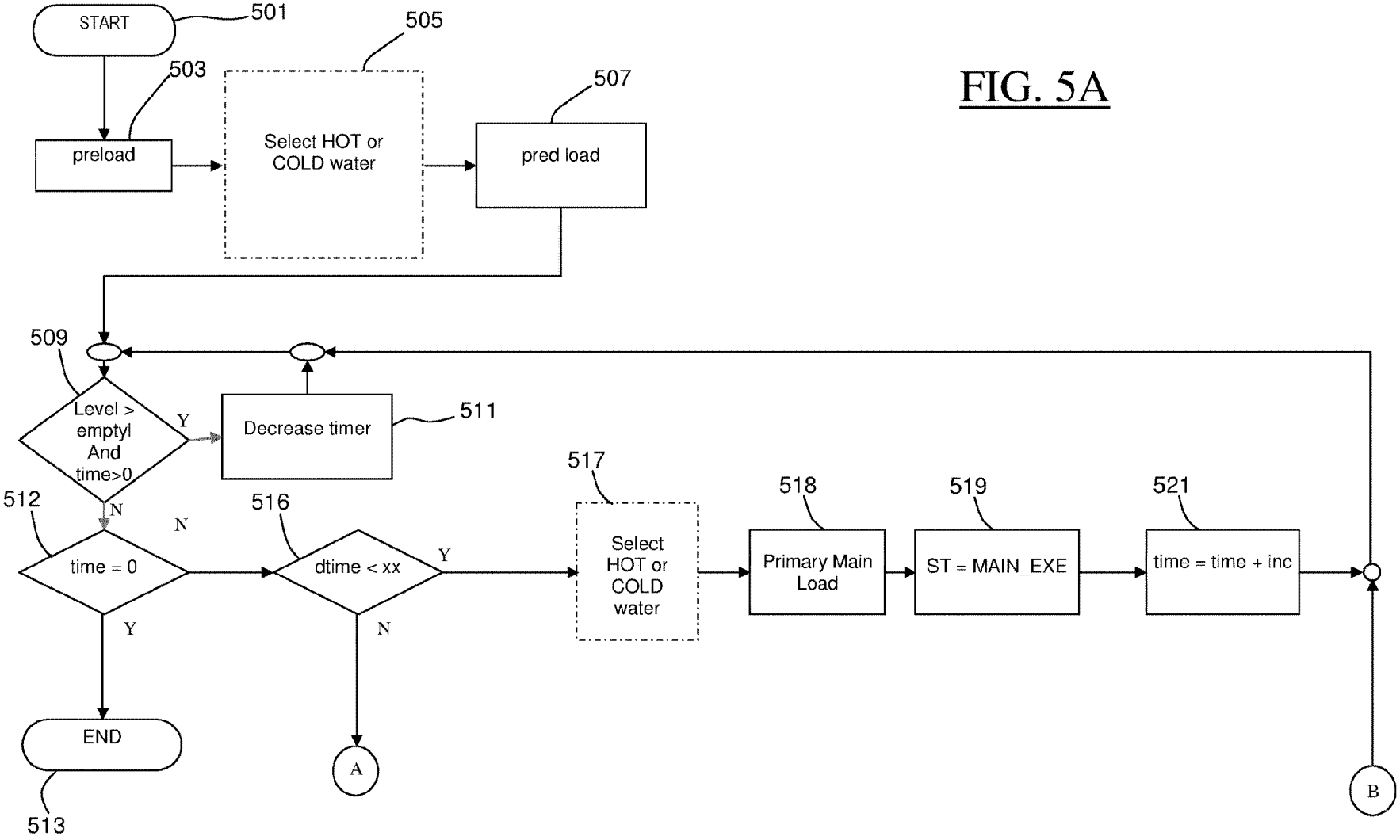
FIGS. 5A-5B show in terms of blocks some steps of a method according to a still further embodiment of the present invention.
Figure 5B:
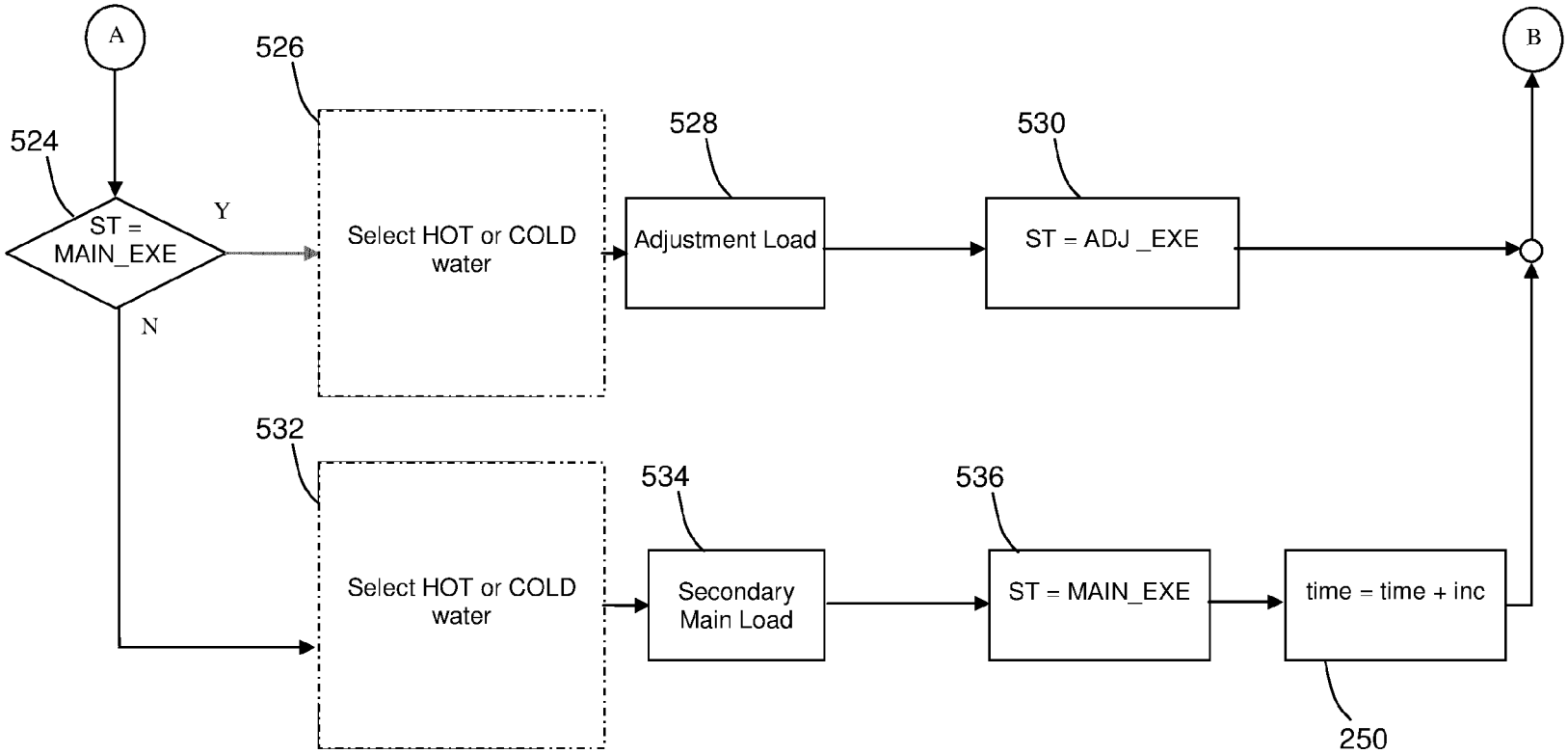

FIGS. 5A-5B illustrate in terms of blocks some steps of another method for loading water in a laundry machine according to a still further embodiment of the present invention.

The first steps of the method of FIGS. 5A-5B substantially coincide with the ones of the method of FIGS. 2A-2C. Specifically, the method starts at 501. At the beginning, a pre-load of a preliminary fixed amount (e.g., 2 litres) of water is preferably made (block 503), for example by opening the electrovalve 120 (or, in case there are two electrovalves for the intake of cold and hot water, by opening preferably the electrovalve corresponding to the cold water). After the water pre-load, depending on the washing program selection made by the user, the control unit 130 advantageously selects (block 505) whether the next water load is to be cold water or hot water; step 505 is not present in case the laundry machine has only one electrovalve for the intake of cold water. Then (i.e., after block 505, if the latter is present, or directly after block 503, if block 505 is not present), a load of a further preliminary fixed amount (e.g., 6 l) of water is performed (block 507); this water load is advantageously controlled by means of the flowmeter 125, and the amount of water to be loaded is preferably the amount of water that would be sufficient for washing a minimum laundry load (e.g., a laundry load ranging from 0 to 1 kg).

Even in this case, the control unit 130 sets a timer time to a start value (e.g., equal to 4-5 minutes), and then enters a wait loop (blocks 509 and 511): during this wait loop, the timer time is progressively decreased, and the level of free water (or the pressure) present in the washing tub 110 is monitored (for example, through the pressure sensor 170). The measured level of free water (or the measured pressure in the tub 110) is then compared to a predetermined minimum level emptyl, for example, a level of 30 mm (or the pressure is compared to a predetermined minimum level emptyp).

As long as the measured level of free water is higher than the minimum level emptyl (or pressure in the tub is higher than the minimum level emptyp) and the value of the timer time is higher than zero, the loop is reiterated (exit branch "Y" of block 509), with the timer time that is decreased, preferably by a unit, every reiteration. As soon as one of the two abovementioned conditions become false (exit branch "N" of block 509), the control unit 130 exits the wait loop, and the timer timer is stopped.

If the exit from the wait loop has been determined by the expiration of the timer time (exit branch "Y" of block 512), the control unit 130 assesses that the amount of water that has been loaded until now in the washing tub 110 is sufficient to guarantee a correct washing of the laundry; in this case, the load of water is considered to be completed, and the method is terminated (block 513).

Conversely (exit branch "N" of block 512), if the measured level of free water falls below the minimum level emptyl (or if pressure in the tub falls below the minimum level emptyp) before the expiration of the timer time, the control unit 130 assesses that the amount of water that has been loaded until now in the washing tub 110 it is not sufficient to guarantee a correct washing of the laundry, and further loads of water should be performed.

Once the control unit 130 has assessed that further loads of water have to be performed, a check is made on the time taken by the level of free water in the washing tub 110 for falling below the minimum level emptyl from the end of the previous partial load (on the time taken by the pressure in the tub for falling below the minimum level emptyp from the end of the previous partial load). In the same way as the method of FIGS. 2A-2C, this check is carried out by comparing the time dtime elapsed during the last wait loop—corresponding to the difference between the value assumed by the timer time at the beginning of the last wait loop and the value assumed when the level of free water falls below emptyl (or the measured pressure falls below emptyp)—with the predetermined threshold xx (block 516).

If the time dtime is lower than the threshold xx (exit branch "Y" of block 516)—meaning that the water in the washing tub 110 has been rapidly absorbed by the laundry located in the laundry drum 115 —, the control unit 130 manages the carrying out of a load of a predetermined substantial amount of water (e.g., 2 liters), herein referred to as "primary main load". Specifically, depending on the washing program selection made by the user, the control unit 130 selects (block 517) whether the water load to be performed is to be cold water or hot water (again, step 517 is not present in case the laundry machine has only one electrovalve for the intake of cold water). Then, the electrovalve 120 is opened and the primary main load is performed (block 518), preferably under the control of the flowmeter 125. In order to signal that a load of a substantial amount of water has been performed, the control unit 130 switches to a corresponding state ST=MAIN_EXE (block 519). Then, the timer time is increased by an incremental amount (e.g., 2 minutes) for allowing the carrying out of refills of further water loads (block 521). At this point, the control unit 130 re-enters the wait loop (returning to block 509), with a refreshed timer time having a value equal to the one assumed at the end of the previous wait loop plus the incremental amount.

Conversely, if the time dtime is higher than the threshold xx (exit branch "N" of block 516)—meaning that the water in the washing tub 110 has been slowly and/or slightly absorbed by the laundry —, the control unit 130 performs a check on its state ST (block 524). If the state ST is equal to MAIN_EXE, the control unit 130 assesses that a load of a substantial amount of water has been just performed, and thus controls the carrying out of an adjustment load of a small amount of water (exit branch "Y" of block 524). If instead the state ST is different than MAIN_EXE, the control unit 130 controls the carrying out of a further load of a substantial amount of water (exit branch "N" of block 524).

In the former case (exit branch "Y" of block 524), depending on the washing program selection made by the user, the control unit 130 selects (block 526) whether the water load to be performed is to be cold water or hot water (again, step 526 is not present in case the laundry machine has only one electrovalve for the intake of cold water). Then, the electrovalve 120 is opened and an adjustment load of a small amount of water (e.g., 0.5 liters) is performed (block 528), preferably under the control of the flowmeter 125. In order to signal that an adjustment load has been performed, the control unit 130 switches to a corresponding state ST=ADJ_EXE (block 530). At this point, the control unit 130 re-enters the wait loop (returning to block 509), with a refreshed timer time having a value equal to the one assumed at the end of the previous wait loop plus the incremental amount.

In the latter case (exit branch "N" of block 524), depending on the washing program selection made by the user, the control unit 130 selects (block 532) whether the water load to be performed is to be cold water or hot water (again, step 532 is not present in case the laundry machine has only one electrovalve for the intake of cold water). Then, the control unit 130 manages the opening of the electrovalve 120 for carrying out a load of a predetermined substantial amount of water (e.g., 1 liter)—herein referred to as "secondary main load"—, preferably under the control of the flowmeter 125. In order to signal that a load of a substantial amount of water has been performed, the control unit 130 switches to the state ST=MAIN_EXE (block 536). Then, the timer time is increased by an incremental amount (e.g., 2 minutes) for allowing the carrying out of refills of further water loads (block 538). At this point, the control unit 130 re-enters the wait loop (returning to block 509), with a refreshed timer time having a value equal to the one assumed at the end of the previous wait loop plus the incremental amount.

In the same way as the method of FIGS. 2A-2C, the method of FIGS. 5A-5B provides for performing a sequence of partial water loads, too. Even in this case, the amount of water in each partial water load of the sequence is selected among a collection of predetermined amounts, including:

- the preliminary fixed amount (e.g., 2 liters) of the load performed at block 503;
- the preliminary fixed amount (e.g., 6 liters) of the load performed at block 507;
- the predetermined substantial amount of water (e.g., 2 liters) of the primary main load performed at block 518;
- the predetermined small amounts (e.g., 0.5 liters) of the adjustment load performed at block 528, and
- the predetermined substantial amount of water (e.g., 1 liter) of the secondary main load performed at block 534.

After the carrying out of a preliminary set of steps, including the loads performed at blocks 503 and 507, the amount of water in each subsequent partial load is selected from the previously listed predetermined amount based on the time dtime taken by the level of free water in the washing tub for falling below the minimum level emptyl from the end of the previous partial load (or on the time taken by the pressure in the tub for falling below the minimum level emptyp from the end of the previous partial load), and the amount of water employed in the previously performed loads. Specifically, as long as the time dtime is lower than the threshold xx, it means that the water has been rapidly absorbed by the laundry; therefore, the water load is carried out by means of the primary main loads. Once the time dtime has been assessed to be higher than the threshold, the water load is carried out by alternating between adjustment loads and secondary main loads.

Figure 6:
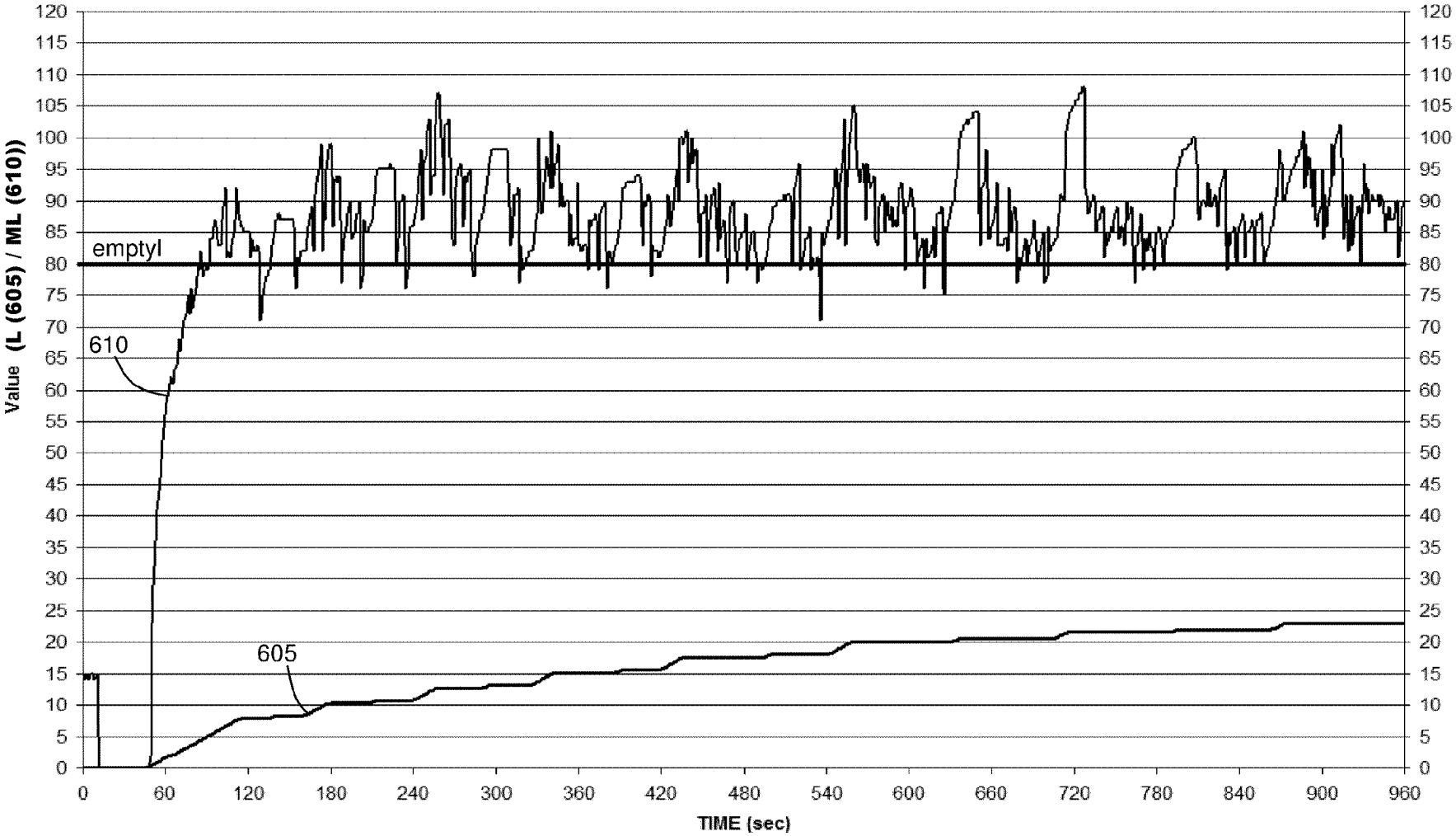
FIG. 6 is a diagram showing an example of the evolution in time of the amount of loaded water and of the corresponding level of water in a washing tub of the laundry machine for the method of FIGS. 5A-5B.

FIG. 6 is an exemplary diagram showing the evolution in time of the amount of loaded water (expressed in liters) and of the level of free water (expressed in millimeters) in the washing tub 110 of the laundry machine 100 during the execution of the method of FIGS. 5A-5B for a full laundry load (e.g., a laundry load of about 8 Kg).

The amount of water loaded through the opening of the electrovalve 120 is identified with the reference 605, while the level of free water in the washing tub 110 is identified with the reference 610. In this case, the predetermined minimum level emptyl is equal to 80 millimeters.

Without entering into excessive details, in this example the water load procedure lasts a longer time compared to the examples illustrated FIGS. 3A and 3B. Indeed, unlike the method of FIGS. 2A-2C, the method of FIG. 5A-5B only provides for performing loads of fixed amounts of water (e.g., 0.5, 1.2 liters); therefore, in order to reach an overall amount of water that fits the actual load of laundry located in the laundry drum, it is necessary to carry out a higher number of loads.

The previous description presents and discusses in detail several embodiments of the present invention; nevertheless, several changes to the described embodiments, as well as different invention embodiments are possible, without departing from the scope defined by the appended claims.

For example, even if the methods herein described begin with the carrying out of pre-loads of preliminary fixed amounts of water, the concepts of the present invention apply in case said pre-loads are not performed.

The invention claimed is:

1. A method for managing a load of washing liquid in a laundry washing machine comprising a washing tub, in which washing liquid may be loaded, and a rotatable drum, rotatably accommodated in the washing tub, for containing laundry to be washed, the method including performing a sequence of partial loads of washing liquid into said washing tub, each partial load providing for loading a corresponding liquid amount in the washing tub, wherein the method comprises for at least one of said partial loads in the sequence, loading into the washing tub a predetermined amount of washing liquid which depends on a washing liquid level of the washing liquid required for a selected washing program and at least one indicative parameter related to a measured level of free washing liquid in one or more of the previous partial loads in the sequence, wherein the predetermined amount of washing liquid for each partial load is directly measured via a metering device configured to measure an exact amount of washing liquid loaded into the washing tub, and transmit a reading of the measured amount to a control unit of the laundry washing machine, wherein the at least one indicative parameter includes a time for the measured level of free washing liquid to fall below a minimum level from an end of a previous partial load, a total amount of washing liquid loaded by the previous partial loads, and a number of adjustment loads performed, wherein each of the adjustment loads includes loading an additional predetermined amount of washing liquid in the washing tub in accordance with an assessment by the control unit, wherein the additional predetermined amount is less than the previous partial load and is less than a next partial load.

2. The method of claim 1, wherein said loading into the washing tub the predetermined amount of washing liquid, for said at least one of said partial loads in the sequence, is conditioned on a predetermined level of free washing liquid in the laundry washing machine not being attained yet.

3. The method of claim 2, wherein said at least one indicative parameter related to one or more of the previous partial loads in the sequence further comprises a level of free washing liquid and/or a value of a liquid pressure in said washing tub reached before said at least one of said partial loads in the sequence.

4. The method of claim 2, wherein said loading into the washing machine the predetermined amount of washing liquid for said at least one of said partial loads in the sequence comprises loading a previously fixed amount of washing liquid selected among a collection of already predetermined partial amounts.

5. The method of claim 1, wherein said at least one indicative parameter related to one or more of the previous partial loads in the sequence further comprises a level of free washing liquid and/or a value of a liquid pressure in said washing tub reached before said at least one of said partial loads in the sequence.

6. The method of claim 5, wherein said loading into the washing machine the predetermined amount of washing liquid for said at least one of said partial loads in the sequence comprises loading a previously fixed amount of washing liquid selected among a collection of already predetermined partial amounts.

7. The method of claim 1, wherein said loading into the washing machine the predetermined amount of washing liquid for said at least one of said partial loads in the sequence comprises loading a previously fixed amount of washing liquid selected among a collection of already predetermined partial amounts.

8. The method of claim 1, wherein said loading into the washing machine the predetermined amount of washing liquid for said at least one of said partial loads in the sequence comprises loading an amount of washing liquid dosed in such a way that the overall liquid amount of washing liquid in the laundry washing machine before said at least one of said partial loads plus said dosed amount reaches a previously fixed quantity.

9. The method of claim 8, wherein said previously fixed quantity is set for the washing of at least one among:

substantially half a standard load of laundry the laundry washing machine is configured to house, and substantially the standard load of laundry the laundry washing machine is configured to house.

10. The method of claim 1, comprising, before said loading into the washing machine the predetermined amount of washing liquid for said at least one of said partial loads in the sequence, selecting whether the next partial load is to be cold washing liquid or hot washing liquid.

11. A method for managing a load of washing liquid in a laundry washing machine comprising a washing tub, in which washing liquid may be loaded, and a rotatable drum, rotatably accommodated in the washing tub, for containing laundry to be washed, the method including performing a sequence of partial loads of washing liquid into said washing tub, each partial load providing for loading a corresponding liquid amount in the washing tub, wherein the method comprises for at least one of said partial loads in the sequence, loading into the washing tub a predetermined amount of washing liquid which depends on at least one indicative parameter related to a measured level of free washing liquid in one or more of the previous partial loads in the sequence, wherein the at least one indicative parameter includes a time taken by the measured level of free washing liquid in the washing tub to fall below a minimum level from an end of a partial load of the one or more of the previous partial loads in the sequence;

said method further comprising determining said partial loads of washing liquid from among a set of partial loads of washing liquid corresponding to different predetermined laundry load states, and adjustment partial loads of washing liquid applicable to one or more of said predetermined laundry load states, said adjustment partial loads of washing liquid being smaller loads as compared to the partial loads of washing liquid corresponding to the predetermined laundry load states, whereby said adjustment partial loads increase the load of washing liquid above a load associated with one of said predetermined laundry load states and below a load of washing liquid associated with a next higher of said predetermined laundry load states.

12. The method of claim 11, wherein said at least one indicative parameter of the one or more of the previous partial loads in the sequence further relates to a number of partial loads previously performed.

13. The method of claim 12, wherein upon performing a said partial load of washing liquid corresponding to a predetermined laundry load state, the number of partial loads previously performed is initialized, and upon performing the adjustment partial load of washing liquid, the number of partial loads previously performed is incremented.

* * * * *